US005333441A

United States Patent [19]

Naegele

[11] Patent Number: 5,333,441

[45] Date of Patent: Aug. 2, 1994

[54] METHOD AND APPARATUS FOR RESTARTING A TEXTILE SPINNING MACHINE WINDING OPERATION FOLLOWING A YARN BREAK

[75] Inventor: Ewald Naegele, Goeppingen-Bartenbach, Fed. Rep. of Germany

[73] Assignee: Zinser Textilmaschinen GmbH, Ebersbach/Fils, Fed. Rep. of Germany

[21] Appl. No.: 898,024

[22] Filed: Jun. 12, 1992

[30] Foreign Application Priority Data

Jun. 12, 1991 [DE] Fed. Rep. of Germany ..... 4119382

[51] Int. Cl.[5] ..... D01H 13/26; D01H 9/00; D01H 13/14

[52] U.S. Cl. ..... 57/262; 57/261; 57/264

[58] Field of Search ..... 57/261, 262, 264, 278, 57/267

[56] References Cited

U.S. PATENT DOCUMENTS

| | | | |
|---|---|---|---|
| 3,591,951 | 7/1971 | Urano et al. | 57/262 |
| 3,664,109 | 5/1972 | Escursell-Prat | 57/261 |
| 3,680,297 | 8/1972 | Lee | 57/261 |
| 3,905,187 | 9/1975 | Harmon et al. | 57/262 |
| 4,132,057 | 1/1979 | Weiss et al. | 57/261 |
| 4,570,433 | 2/1986 | Nickolay | 57/261 X |
| 4,729,216 | 3/1988 | Rohner et al. | 57/261 X |
| 4,878,344 | 11/1989 | Igel | 57/261 |
| 5,090,189 | 2/1992 | Wey et al. | 57/261 |

FOREIGN PATENT DOCUMENTS

| | | |
|---|---|---|
| 2009095 | 9/1970 | Fed. Rep. of Germany . |
| 3209814A1 | 3/1982 | Fed. Rep. of Germany . |

*Primary Examiner*—Daniel P. Stodola
*Assistant Examiner*—William Stryjewski

[57] ABSTRACT

A method and apparatus for sequentially applying suction and auxiliary yarn to a yarn package of a textile spinning machine. The apparatus is operable to position yarn extending from a tube during a restarting operation in which the winding the yarn is restarted after the occurrence of a break in yarn being fed from a drafting device onto a tube. The apparatus includes a support assembly which supports a suction applying device as well as an auxiliary yarn length delivery device for simultaneous lateral movement of the two devices toward a tube from which a trailing end of wound yarn is to be drawn. The apparatus also includes a control device for controlling the suction applying device to initially apply suction to the tube for predetermined length of time to thereby draw in a trailing end of wound yarn and, if a trailing end of wound yarn is not drawn in, to control the auxiliary yarn length delivery device to deliver a length of auxiliary yarn onto the tube. The apparatus also includes an assembly for either the suction applying device or the auxiliary yarn length delivery device to a yarn extending position at which the extending yarn can be engaged by, for example, a conventional yarn end engaging device, for transfer of the yarn to a piecing location for piecing with the yarn extending from the drafting device.

16 Claims, 5 Drawing Sheets

15
16
21
17
22
25
27
28
II
II'
13
12
21
22
29
18
24
14
19
1
34
10
9
5
8
20
6
7

21
16
35
12
22
13
I
I'
21
25
27
28
22
III
1
34
10
9
17
15
29
19
5
8
20
7
6

METHOD AND APPARATUS FOR RESTARTING A TEXTILE SPINNING MACHINE WINDING OPERATION FOLLOWING A YARN BREAK

BACKGROUND OF THE INVENTION

The present invention relates to a method and apparatus for sequentially applying suction and auxiliary yarn to a yarn package of a textile ring spinning machine.

German Patent Document DE-OS 32 09 814 discloses a device for restarting a yarn winding operation on a textile spinning machine in which the winding operation involves drafting yarn from a yarn supply package through a drafting device and winding the yarn on a tube to form a full yarn package. The known device includes an optical sensor which senses the occurrence of a break in the yarn, which break results in an end of unwound yarn extending from the drafting device and a trailing end of wound yarn on the tube, an assembly for drawing in and retaining the end of unwound yarn which has been drafted through the drafting device, another assembly for drawing in and retaining the trailing end of yarn which has been wound on the tube, and an assembly for positioning the other assemblies in their respective positions in which they engage the respective yarn ends. Additionally, the known device includes an auxiliary yarn delivery assembly including a Venturi-type conduit divided into two portions for directing suction or streams of air radially against the yarn package being wound. While prior art arrangements such as disclosed in DE-OS 32 09 814 provide a capability to initially apply suction for engaging a trailing end of yarn wound in a tube and, if necessary, to provide thereafter a length of auxiliary yarn to insure that the yarn winding operation can be restarted, the art still seeks improvements leading to a relatively simple and reliable apparatus and method for restarting a yarn winding operation on a textile spinning machine following a yarn break.

SUMMARY OF THE INVENTION

Briefly described, the present invention provides, in one aspect thereof, a method for restarting a winding operation on a textile spinning machine, the winding operation being an operation in which yarn supplied from a supply package is drafted through a drafting device and wound on a tube to form a full package and the restarting of the winding operation being performed to restart the winding of yarn onto a tube following a break in the yarn being fed from the drafting device to the tube wherein the break in the yarn results in a end of unwound yarn which has been drafted through the drafting device but not yet wound on the tube and a trailing end of wound yarn on the tube. The method includes positioning a suction applying means in a tube addressing position at which the suction applying means can apply suction to the tube and positioning a means for delivering a length of auxiliary yarn in a tube addressing position simultaneously with the positioning of the suction applying means in its tube addressing position. Also, the method includes controlling the suction applying means to apply suction to the tube to draw a trailing end of wound yarn therefrom. Additionally, the method includes controlling the auxiliary yarn length delivery means to deliver a length of auxiliary yarn to the tube in response to the failure of the suction applying means to draw in a trailing end of wound yarn, whereby yarn extends from the tube to a respective one of the suction applying means and the auxiliary yarn length delivery means. Further, the method includes removing the respective one of the suction applying means and the auxiliary yarn length delivery means to a yarn extending position in which the yarn extending from the tube is disposed generally at the same location for subsequent handling thereof whether the yarn extends to the tube from the suction applying means or from the auxiliary yarn length delivery means.

According to one feature of the one aspect of the present invention, the method further includes intermediately moving the respective one of the suction applying means and the auxiliary yarn length delivery means to an intermediate handling location for intermediate handling of the yarn extending from the tube prior to the moving of the respective one of the suction applying means and the auxiliary yarn length delivery means to the yarn extending position.

According to another aspect of the present invention, there is provided an apparatus for the restarting of a winding operation on a textile spinning machine, the winding operation being an operation in which yarn supplied from a supply package is drafted through a drafting device and wound on a tube to form a full package and the restarting of the winding operation being performed to restart the winding of yarn onto a tube following a break in the yarn being fed from the drafting device results in an end of unwound yarn which has been drafted through the drafting device but not yet wound on the tube and a trailing end of wound yarn on the tube. The apparatus includes means for applying suction to a tube to draw a trailing end of wound yarn therefrom, the suction applying means being positionable in a tube addressing position at which it applies suction to the tube. Also, the apparatus includes means for delivering a length of auxiliary yarn to a tube for subsequent winding of the length of auxiliary yarn thereon, the auxiliary yarn length delivering means being positionable in a tube addressing position at which it delivers the length of auxiliary yarn to the tube. Additionally, the apparatus includes means supporting the suction applying means and the auxiliary yarn length delivery means for simultaneous lateral movement thereof from laterally outward positions toward the tube into their respective tube addressing positions.

The apparatus further includes means for controlling the operation of the suction applying means and the auxiliary yarn length delivery means for sequential operation to apply suction by the suction applying means and, in response to failure of the suction applying means to draw a trailing end of wound yarn from the tube, to deliver a length of auxiliary yarn from the auxiliary yarn length delivery means to the tube, whereby yarn extends from the tube to a respective one of the suction applying means and the auxiliary yarn length delivery means. The apparatus also includes means for moving at least the respective one of the suction applying means and the auxiliary yarn length delivery means from its tube addressing position to a yarn extending position in which the yarn extending from the tube is disposed generally at the same location for subsequent handling thereof whether the yarn extends to the tube from the suction applying means or from the auxiliary yarn length delivery means.

According to one feature of the another aspect of the present invention, the supporting means includes a laterally extending guide member, the suction applying means and the auxiliary yarn length delivery means being mounted on the laterally extending guide member for laterally guided movement therealong between their laterally outward positions and their respective tube addressing positions.

According to an additional feature of the another aspect of the present invention, the apparatus further includes means for applying a stream of air relative to the tube for facilitating the dislodgement of a trailing end of wound yarn therefrom in correspondence with the application of suction to the tube by the suction applying means, the air stream applying means being positionable in a tube addressing position for applying a stream of air to the tube and the supporting means supporting the suction applying means, the auxiliary yarn length delivery means, and the air stream applying means for simultaneous lateral movement thereof from laterally outward positions toward the tube into their respective tube addressing positions. Preferably, the supporting means includes means for rolling support of the suction applying means, the auxiliary yarn length delivery means, and the air stream applying means along the laterally extending guide member and means for driving the rolling support means along the laterally extending guide member.

According to yet another feature of the another aspect of the present invention, the supporting means includes an axial guide member for guiding movement of the suction applying means and the auxiliary yarn length delivery means in an axial direction relative to the axis of the tube. The suction applying means is preferably supported axially above the auxiliary yarn length delivery means relative to the axis of the tube in the direction from the bottom of the tube toward the top of the tube and the supporting means includes a first axial movement stop for limiting axial movement of the suction applying means beyond a first axial location. Also, the supporting means preferably includes a second axial movement stop for limiting axial movement of the suction applying means beyond a second axial location in the direction from the top of the tube toward the bottom of the tube.

In a preferred construction of the another aspect of the present invention, the supporting means includes means for rolling support of the suction applying means, the auxiliary yarn length delivery means, and the air stream applying means along the laterally extending guide member and means for driving the rolling support means along the laterally extending guide member and a second axial movement stop for limiting axial movement of the suction applying means beyond a second axial location in the direction from the top of the tube toward the bottom of the tube, the second axial movement stop being mounted to the rolling support means for lateral movement therewith along the laterally extending guide member.

According to yet a further additional feature of the another aspect of the present invention, the apparatus includes means for detecting the relative axial position of an axially movable component of the textile spinning machine and means for controlling the axial positioning of the suction applying means in response to the detection of the relative axial position of the textile spinning machine component to effect positioning of the suction applying means out of interference with the textile spinning machine component.

DESCRIPTION OF THE PREFERRED EMBODIMENT

Figure 1:
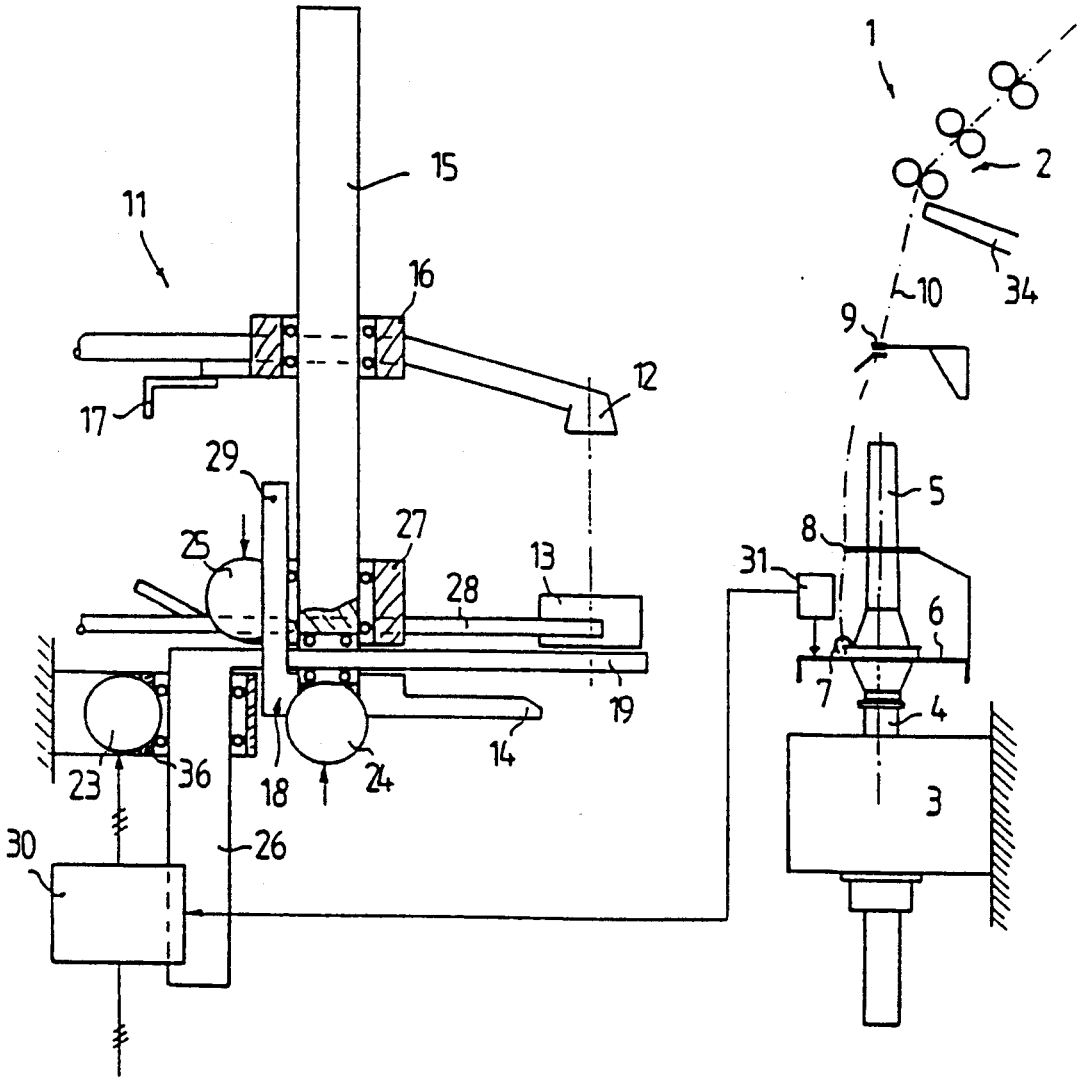
FIG. 1 is a schematic side elevational view of the yarn end preparing apparatus of the present invention in its laterally outward position relative to the spindle of a textile ring spinning machine.

In FIGS. 1-9, the preferred embodiment of the yarn end preparing apparatus 11 of the present invention is illustrated in its supported disposition on a conventional traveling service unit (not shown) which services the spindles 4 of a spindle bank 3 extending along one side of a textile ring spinning machine 1. The textile ring spinning machine i includes a drafting device 2 through which yarn drawn from a supply package (not shown) is drafted during a winding operation. Following its drafting through the drafting device 2, a drafted yarn 10 sequentially travels through a yarn guide 9 and a balloon control ring 8 before being wound by a traveler 7 of a ring rail 6 onto a tube 5 to form a full yarn package. The textile ring spinning machine 1 simultaneously winds yarn onto a plurality of tubes 5, only one of which is shown in FIGS. 1–9, as the tubes are individually rotatably supported on the spindles 4.

In the event of a break in the drafted yarn 10 traveling between the drafting device 2 and the tube 5, a yarn restarting operation is initiated to restart the yarn winding operation and the yarn end preparing apparatus 11 performs a yarn end positioning operation, as described in more detail below, as part of the yarn restarting operation. In the event of a break of the drafted yarn 10 at a location between the drafting device 2 and the tube 5, there is created, as a result of the break, an end of unwound yarn which has been drafted through the drafting device 2 but not wound onto the tube 5 and this unwound yarn end is drawn by suction into a suction conduit 34 positioned adjacent the lower end of the drafting device 2 for maintaining the unwound yarn end in an available location for subsequent piecing thereof with a yarn end extending from the tube 5. Additionally, the yarn break results in a trailing end yarn wound on the tube 5.

Figure 6:
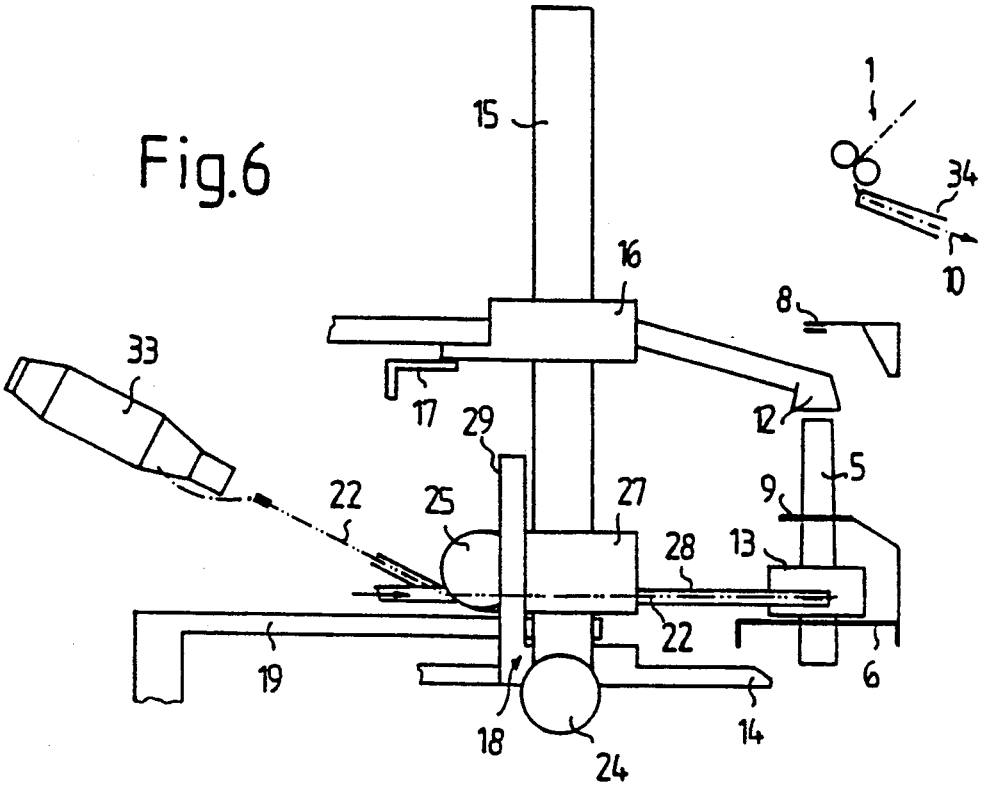
FIG. 6 is a schematic side elevational view of a portion of the yarn end preparing apparatus shown in FIG. 1, showing the suction applying means and the auxiliary yarn length delivery means in their respective tube addressing positions relative to an empty tube during the delivery of a length of auxiliary yarn to the empty tube.

As seen in particular in FIG. 1, the yarn end preparing apparatus 11 includes a means for applying suction to the tube 5 to draw a trailing end of wound yarn therefrom. The suction applying means is in the form of a suction housing 12 having a generally bell-shaped opening for applying suction therethrough to draw a trailing end of wound yarn into the suction housing. The suction housing 12 is operatively connected to a conventional suction source (not shown), which may be mounted on a traveling service unit, and the suction housing 12 is positionable in a tube addressing position at which it applies suction to the tube to draw a trailing end of wound yarn therefrom. The yarn end preparing apparatus 11 additionally includes means for delivering a length of auxiliary yarn to the tube 5 for subsequent winding of the length of auxiliary yarn thereon. The auxiliary yarn length delivery means is preferably in the form of delivery assembly 13 having a conduit housing 28 having one open end positionable adjacent the tube 5 for delivery of a length of auxiliary yarn through the conduit housing onto the tube 5 and second open end through which, as seen in FIG. 6, an auxiliary yarn 22 is drawn from an auxiliary yarn package 33 into the conduit housing 28. The delivery assembly 13 is positionable in a tube addressing position at which it delivers a length of auxiliary yarn to the tube 5.

The yarn end preparing apparatus 11 further includes means for supporting the suction applying means and the auxiliary yarn length delivery means for simultaneous lateral movement thereof from laterally outward positions toward the tube 5 into their respective tube addressing positions. The supporting means includes a platform assembly 18 having a means for guiding the suction housing 12 and the delivery assembly 13 for vertical or axial movement relative to the axis of the tube 5 in the form of a column 15. The suction housing 12 is mounted on a carrier 16 having a pair of bearing assemblies, each for rolling travel along a respective opposed longitudinal side of the column 15 for movement of the suction housing 12 relative to the column 15 in guided manner therealong.

The delivery assembly 13 is mounted to a carrier 27, which comprises a pair of bearing assemblies each disposed for rolling travel along a respective opposed longitudinal side of the column 15 for movement of the delivery assembly 13 relative to the column 15 in guided manner therealong. A vertical drive motor 25 is operatively mounted on the carrier 27 for driving movement of the delivery assembly 13 along the column 15.

The base of the column 15 is mounted by a pair of opposed bearing assemblies to a lateral leg 19 of a guide platform 26 for lateral movement of the column 15 toward and away from the spindle 4 on which the tube 5 is mounted. The guide platform 26 includes a body portion extending perpendicularly to its lateral leg 19 and supported between a pair opposed bearing assemblies 36 for vertical or axial movement of the guide platform 26. A vertical drive motor 23 is operatively connected to the guide platform 26 for driving movement thereof in a vertical or axial direction while the guide platform is rotatably supported between the opposed bearings of the bearing assemblies 36, which are mounted to a bracket on the traveling service unit.

The pair of opposed bearing assemblies of the column 15 which mount the column on the lateral leg 19 each travel along a respective opposed longitudinal surface of the lateral leg 19 and the column 15 includes a lateral drive motor 24 for driving movement of the column 15 in a lateral direction with the suction housing 12 and the delivery assembly 13 mounted thereon.

Figure 4:
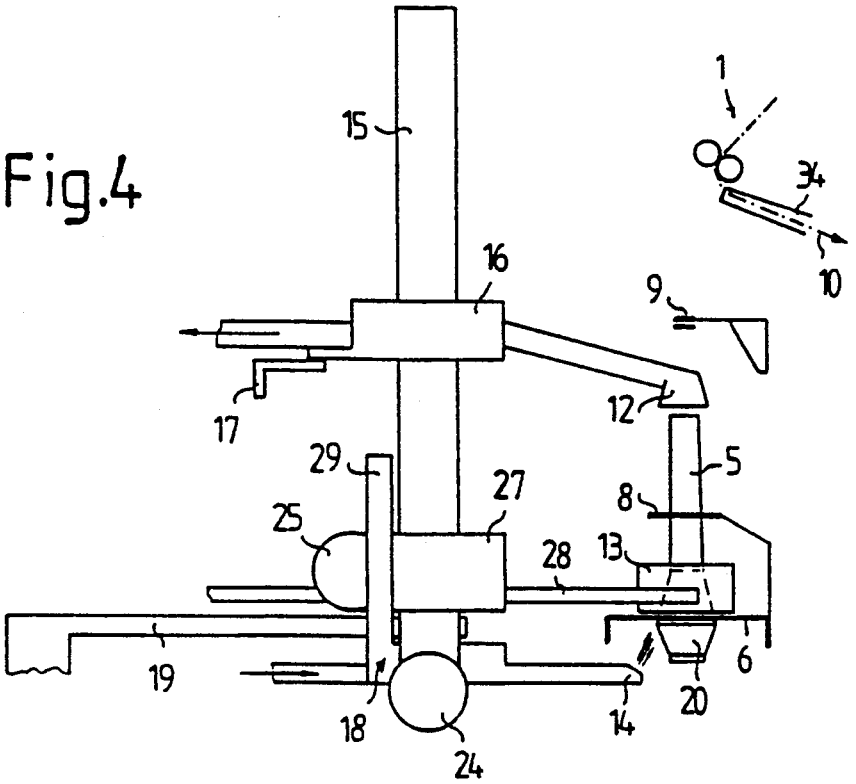
FIG. 4 is a schematic side elevational view of the yarn and preparing apparatus shown in FIG. 2 during the application of suction by the suction applying means.

The yarn end preparing apparatus 11 also includes nozzle means for applying a stream of air relative to the tube for facilitating the dislodgement of a trailing end of wound yarn therefrom in coordination with the application of suction to the tube by the suction housing 12. The nozzle means is in the form of a nozzle conduit 14 extending laterally and having an open end through which the stream of air passes toward the tube 5. The nozzle conduit 14 is mounted to the column 15 for movement therewith during lateral movement of the column 15 along the lateral leg 19 and the lateral location of the open end of the nozzle conduit 14 is selected in consideration of the lateral location of the bell-shaped opening of the suction housing 12 such that, as seen in FIG. 4, the opening of the nozzle conduit 14 is positioned for applying a stream of air to the tube 5 in coordination with the application of suction through the bellshaped opening of the suction conduit 12.

As seen in FIG. 1, the yarn end preparing apparatus 11 further includes a first vertical movement stop 17 mounted to the traveling service unit at a selected location for supporting the suction housing 12 at a first predetermined vertical position relative to the spindle bank 3. The first vertical movement stop 17, which may be mounted to the traveling service unit, is movable laterally in coordination with the movement of the column 15 to continuously support the suction housing 12 at a first predetermined vertical position during lateral movement thereof.

Additionally, the yarn end preparing apparatus includes a second vertical movement stop 29 formed as a column extending parallel to the column 15 and mounted to the column 15 for lateral movement therewith. The vertical extent of the second vertical movement stop 29 is selected such that the suction housing 12 is supported on the stop at a second predetermined vertical position. Since the second vertical movement stop 29 is mounted to the column 15 for lateral movement therewith, the stop is operable to support the suction housing 12 at any respective lateral position of the column 15 whereas, in contrast, the first vertical movement stop 17 is operable to support the suction housing 12 only if the column 15 is at a lateral position which permits the suction housing 12 to rest upon the stop. The second vertical movement stop 29 assures proper positioning of the suction housing 12 relative to the tube 5 during at least one situation, described in more detail below, in which the suction housing 12 must be supported at a clearance from certain components of the textile ring spinning machine.

At least one conventional sensor 31 is supported by the traveling service unit at a position relative to the yarn traveling onto the tube 5 to detect the vertical position of the ring rail 6. The detector 31 is operatively connected to a control unit 30 which, in turn, is operatively connected to the pair of vertical drive motors 23,25, as well as the lateral drive motor 24, for control of these motors and, in this regard, the motors 23–25 can be conventional electric motors for accurate control thereof.

Figure 2:
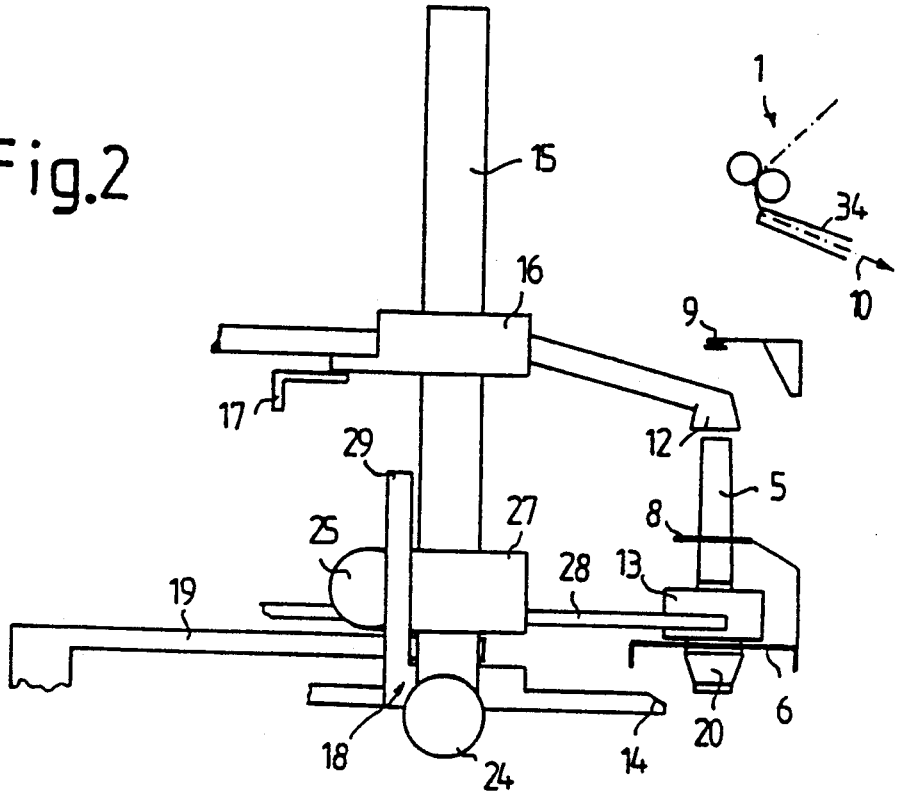
FIG. 2 is a schematic side elevational view of a portion of the yarn end preparing apparatus shown in FIG. 1, showing the suction applying means and the auxiliary yarn length delivery means in their respective tube addressing positions relative to a tube with the ring rail of the textile ring spinning machine in a lower travel position.
Figure 9:
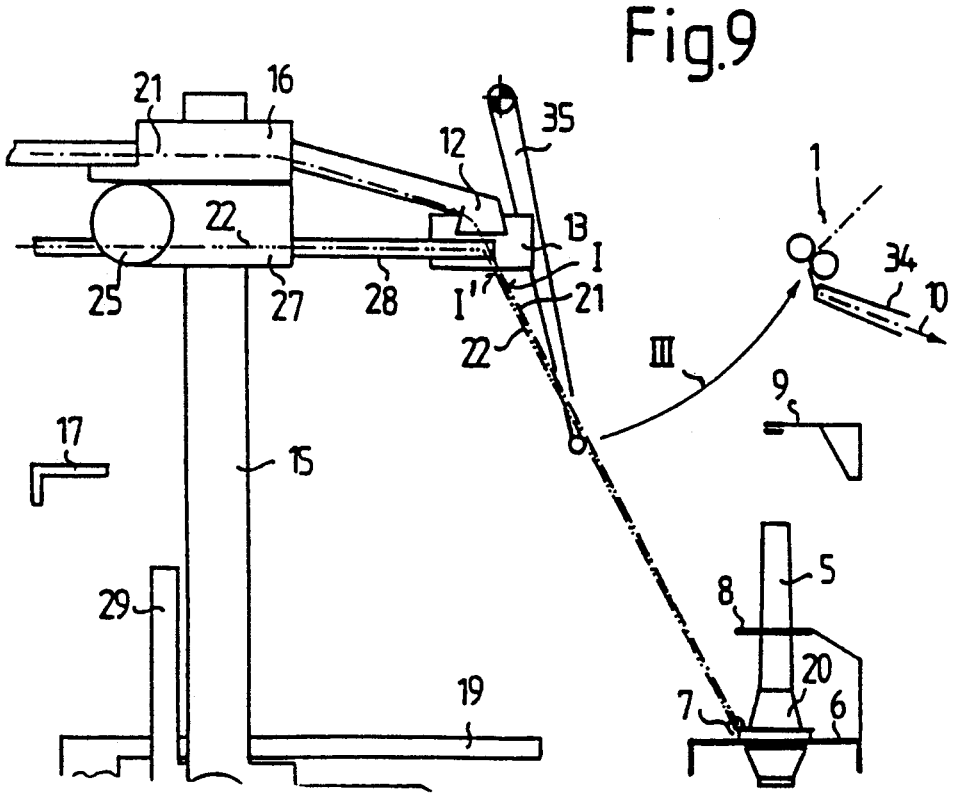
FIG. 9 is a schematic side elevational view of the yarn end preparing apparatus shown in FIG. 1, showing the suction applying means and the auxiliary yarn length delivery means in their respective positions for supporting yarn extending from the tube at a transfer location for subsequent transfer of the yarn into position for piecing with the yarn extending through the drafting device of the textile spinning machine.

The yarn end preparing apparatus 11 operates as follows to extend yarn from the tube 5 in a transfer position for subsequent engagement of the yarn by another component of the traveling service unit or the textile spinning machine 1 during the yarn restarting operation. For example, a conventional piecing device 35 as seen in FIG. 9, may be provided to transfer the engaged yarn along a path III as seen in FIG. 9 terminating adjacent the lower end of the drafting device 2. Before the commencement of a yarn restarting operation during which the yarn end preparing apparatus 11 performs its yarn positioning function, the yarn end preparing apparatus 11 is disposed in a position as shown in FIG. 1 in which the suction housing 12, the delivery assembly 13, and the nozzle conduit 14 are disposed in laterally outward positions from the spindle 4. In dependence upon the detected vertical position of the ring rail 6 as detected by the detector 31, the control unit 30 controls the motors 23–25 as appropriate to simultaneously move the suction housing 12, the delivery assembly 13, and the nozzle conduit 14 to their respective tube addressing positions. For example, as seen in FIG. 2, if the detector 30 detects that the ring rail 6 is in a lower position relative to the spindle 4—as may be the situation if a yarn break has occurred during the winding of the lower tapering portion of the package onto the tube 5—the lateral drive motor 24 advances the column 15 laterally toward the spindle 4 with the suction housing 12 supported on the first vertical movement stop 17 at the appropriate vertical height relative to the tube 5 for disposition of the bell opening of the suction housing above the top of the tube.

The delivery assembly 13 and the nozzle conduit 14 simultaneously reach their respective tube addressing positions as the suction housing 12 reaches its tube addressing position due to the joint movement of these three elements by the column 15 under driving movement of the lateral drive motor 24. During this lateral movement toward the spindle 4, the lateral leg 19 guides the movement of the column 15.

Figure 8:
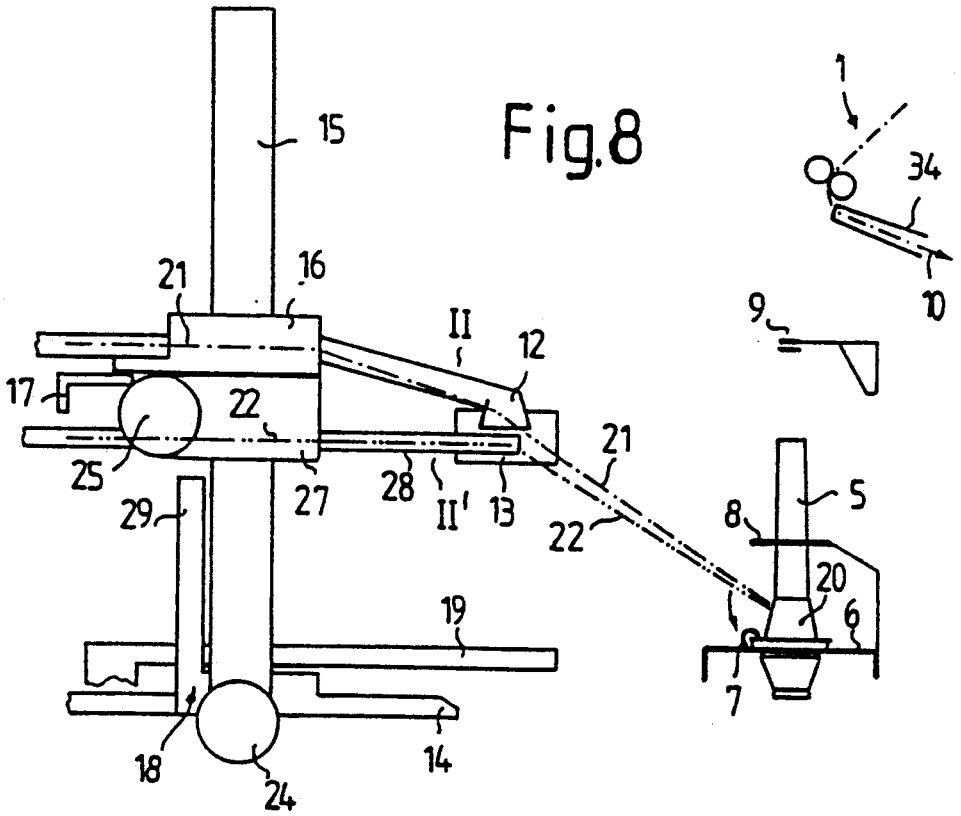
FIG. 8 is a schematic side elevational view of a portion of the yarn end preparing apparatus shown in FIG. 1, showing the suction applying means and the auxiliary yarn length delivery means in their respective positions for supporting yarn extending from the tube at an intermediate handling location.

As seen in FIG. 4, in correspondence with the simultaneous arrival of the suction housing 12, the delivery assembly 13, and the nozzle conduit 14 at their respective tube addressing positions, the control unit 30 controls the suction housing 12 to apply suction to the tube 5 and simultaneously controls the nozzle conduit 14 to direct a stream of air against the body of yarn 20 formed on the tube 5 to facilitate the dislodgement of a trailing end of wound yarn therefrom. During this simultaneous suction applying and air stream applying operation, the delivery assembly 13 is not operated but remains positioned in its tube addressing position. If the combined suction and air stream action succeeds in loosening a trailing end of wound yarn from the tube 5, the thus-loosened trailing end of wound yarn is drawn into the suction housing 12 and, in correspondence with this successful drawing in of the trailing end (which may, for example, be detected by a conventional sensor (not shown) in the suction housing 12) the lateral drive motor 24 is controlled to move the column 15 laterally outwardly relative to the spindle 4 to a lateral position in which the trailing end of wound yarn 21 which has been drawn into the suction housing 12 is positioned at an intermediate handling position II, as shown in FIG. 8. The yarn extending from the tube 5 to the suction housing 12 is positioned at the intermediate handling location, if desired, for subsequent engagement of the yarn to dispose it in the traveler 7, for example, or to otherwise manipulate the yarn prior to piecing thereof with the end of unwound yarn extending from the drafting device 2. The trailing end of wound yarn 21 can then be engaged by, for example, a conventional device (not shown) for disposing the yarn in the balloon control ring 8 and the yarn guide 9 preliminary to piecing of the yarn end with the end of unwound yarn extending from the drafting device 2.

U.S. Pat. No. 5,090,181 to Wey et al, which is hereby incorporated by reference herein, discloses a traveling service unit having a suction applying means and an assembly for delivering a length of auxiliary yarn both of which are mounted to a traveling service unit and is illustrative of a mounting arrangement for mounting both a suction applying means and an auxiliary yarn length delivery means laterally of a textile spinning machine.

It may happen that the suction housing 12 fails to draw in a trailing end of wound yarn from the tube 5 and, in response to such a failure (which can be detected by a conventional sensor (not shown) disposed in the suction housing 12 which senses the absence of a drawn in yarn end after a predetermined length of time), the control unit 30 de-activates the application of suction through the suction housing 12 and ceases the operation of the nozzle conduit 14. Simultaneously, the control unit 30 activates the delivery assembly 13, as seen in FIG. 6, to advance an auxiliary yarn 22 drawn from the auxiliary yarn package 33 through the conduit 28 and onto the tube 5 (or the body of yarn 20 formed thereon). In this regard, the delivery assembly 13 may include a conventional injector-type yarn advancing means (not shown) for advancing the auxiliary yarn 22 through the delivery assembly. In correspondence with the delivery of the auxiliary yarn 22 onto the tube 5 or its yarn portion 20, the tube is rotated in a winding direction to effect winding of the auxiliary yarn 22 onto the tube.

Figure 7:
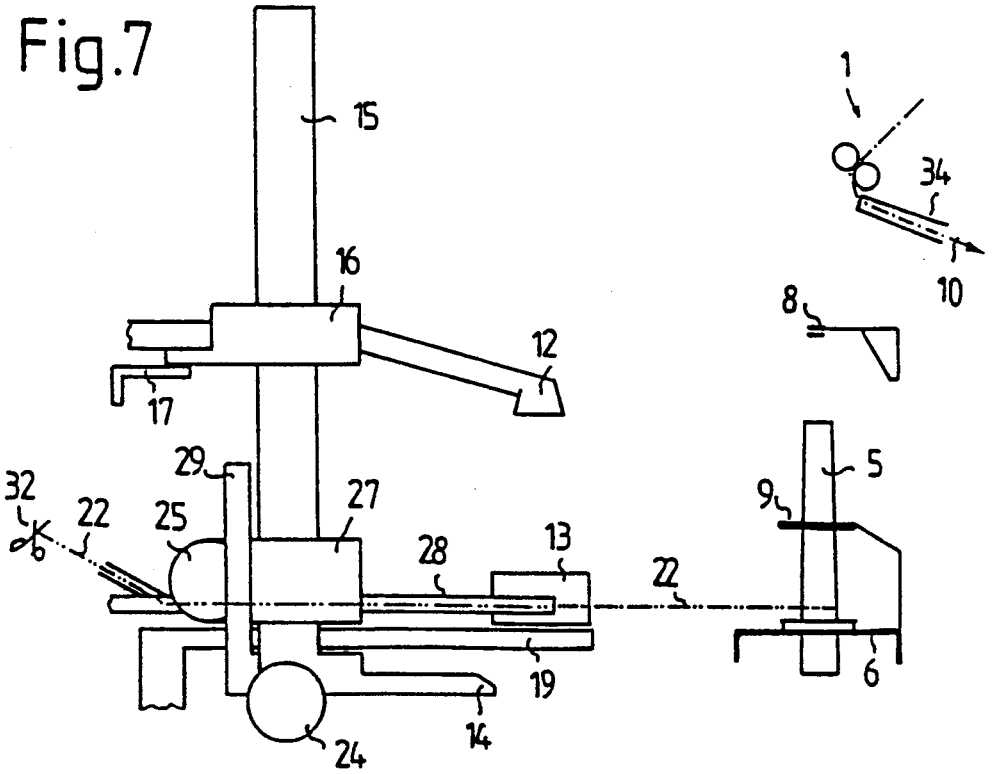
FIG. 7 is a schematic side elevational view of the yarn end preparing apparatus shown in FIG. 6 following movement thereof laterally outwardly of a tube after a length of auxiliary yarn has been delivered thereto.

In correspondence with the completion of winding of the predetermined number of turns of the auxiliary yarn 22 onto the tube 5, the control unit 30 controls the lateral drive motor 24 to move the column 15 laterally outwardly relative to the spindle 4 from the position of the column shown in FIG. 6 to the position of the column shown in FIG. 7, at which the auxiliary yarn 22 extends from the tube 5 through the delivery assembly 13 to the auxiliary yarn package 33. Additionally, a conventional yarn cutting device 32 as seen in FIG. 7 is activated to cut the auxiliary yarn 22, thereby creating a length of the auxiliary yarn 22 extending from the tube 5 to the delivery assembly 13.

In correspondence with the cutting of the auxiliary yarn 22, the control unit 30 controls the vertical drive motor 25 to drive the delivery assembly 13 vertically or longitudinally along the column 15 from the position shown in FIG. 7 to the position shown in FIG. 8 in which the delivery assembly 13 supports the auxiliary yarn 22 extending thereto from the tube 5 at an intermediate handling location II'. The intermediate handling location II' generally corresponds to the intermediate handling location II at which the suction housing 12 would otherwise support a yarn 21 if the suction applying operation had been successful in drawing in the yarn end into the suction housing. Thus, the auxiliary yarn 22 can be transferred in the same manner as the yarn 21 would have been transferred to be fed into the traveler 7 or otherwise manipulated.

Although FIG. 8 shows that the carrier 16 of the suction housing 12 is still supported on the first vertical movement stop 17 when the delivery assembly 13 is positioned for intermediate handling of the auxiliary yarn 22, the suction housing 12 can be raised from the first vertical movement stop 17 by the delivery assembly 13 if it is necessary to move the delivery assembly 13 vertically or longitudinally further along the column 15 to effect placement of the auxiliary yarn 22 in the intermediate handling location II'.

Once yarn has been transferred from the respective one of the intermediate handling locations II or II' (depending on the respective one of the suction housing 12 and the delivery assembly 13 to which the yarn extends from the tube 5), the control unit 30 controls the vertical drive motor 25 to raise the delivery assembly 13 further along the column 15 to a selected location at which the yarn extending from the tube 5 can be engaged by the yarn end engaging device 35 for transfer of the yarn from the respective one of the suction housing 12 and the delivery assembly 13 to a location below the drafting device 2 for piecing of the yarn with the end of unwound yarn extending from a drafting device. As seen in FIG. 9, the carrier 27 of the delivery assembly 13 supports the carrier 16 of the suction housing 13 thereon such that the suction housing 12 is raised from the first vertical movement stop 17 once the delivery assembly 13 has risen along the column 15 above a predetermined location. The extent to which the delivery assembly 13 is raised along the column 15 depends upon which one of the suction housing 12 and the delivery assembly 13 is engaging the yarn extending from the tube 5. As seen in FIG. 9, if the yarn extends from the tube 5 to the suction housing 12, the suction housing 12 is raised by the upward movement of the delivery assembly 13 to a predetermined vertical position on the column 15 at which the yarn extending from the suction housing extends along a transfer path I which intersects the path of movement of the yarn end transfer device 35. On the other hand, if yarn extends from the tube 5 to the delivery assembly 13, the delivery assembly is raised to a predetermined vertical location on the column 15 so that the auxiliary yarn 22 extending to the delivery assembly extends along a transfer path I' which, likewise, intersects travel path of the yarn end transfer device 35.

Depending upon the configurations of the suction housing 12 and the delivery assembly 13, the transfer paths I,I' may be substantially coincidental, but reliable engagement of the yarn extending from the tube 5 by the yarn end transfer device 35, be it the yarn 21 or the auxiliary yarn 22, can be accomplished even if the transfer paths I,I' are not coincidental, so long as the yarn 21 or the auxiliary yarn 22 extend from the tube within the sweep or movement range of the yarn end transfer device 35. Once the respective yarn 21 or the auxiliary yarn 22 has been engaged by the yarn end transfer device 35, the delivery assembly 13, with the suction housing 12 supported thereon, can be lowered along the column 15 with the suction housing 12 again coming to rest on the first vertical movement stop 17 and the delivery assembly 13 traveling further downwardly along the column 15 to come to rest in its respective vertical position for subsequent lateral movement toward another tube 5 in a subsequent yarn restarting operation.

Figure 5:
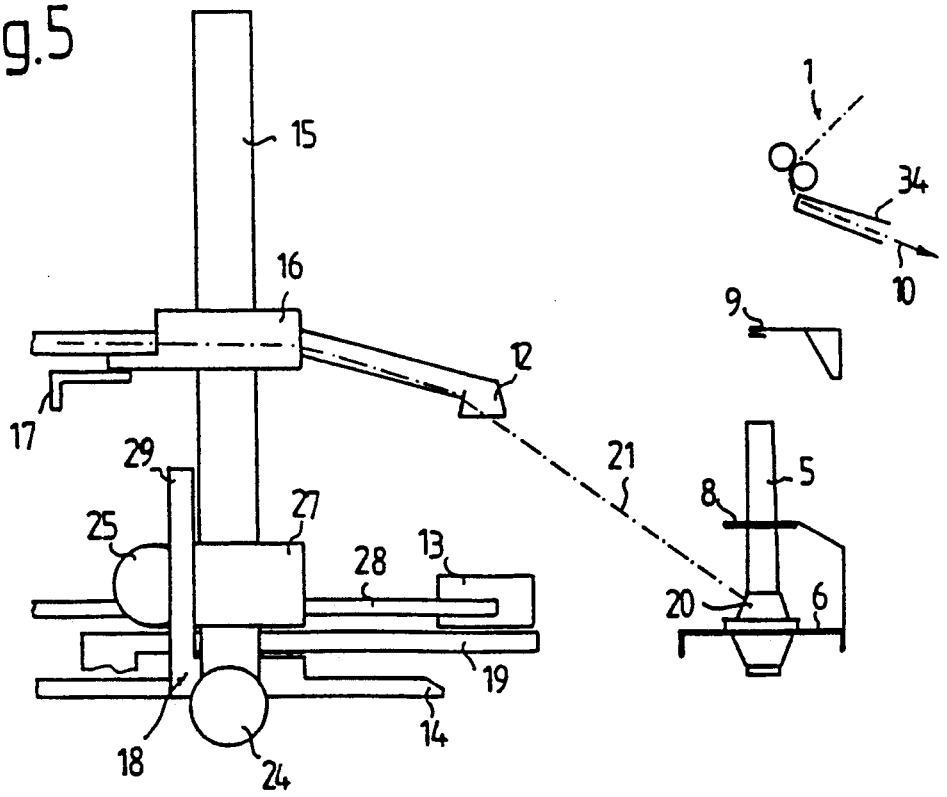
FIG. 5 is a schematic side elevational view of the yarn end preparing apparatus shown in FIG. 4 following movement thereof laterally away from a tube after a trailing end of wound yarn on the tube has been engaged by the suction applying means.

While the operation of the yarn end preparing apparatus 11 has been described as including the positioning of the suction housing 12 or the delivery assembly 13 at the respective positions shown in FIG. 8 for intermediate handling or manipulation of the yarn extending from the tube 5, the present invention also contemplates that the suction housing 12 or the delivery assembly 13 can be moved directly from its position in FIG. 5 or FIG. 7, respectively, to its respective position shown in FIG. 9 without any intermediate handling or manipulation of the yarn extending thereto.

Figure 3:
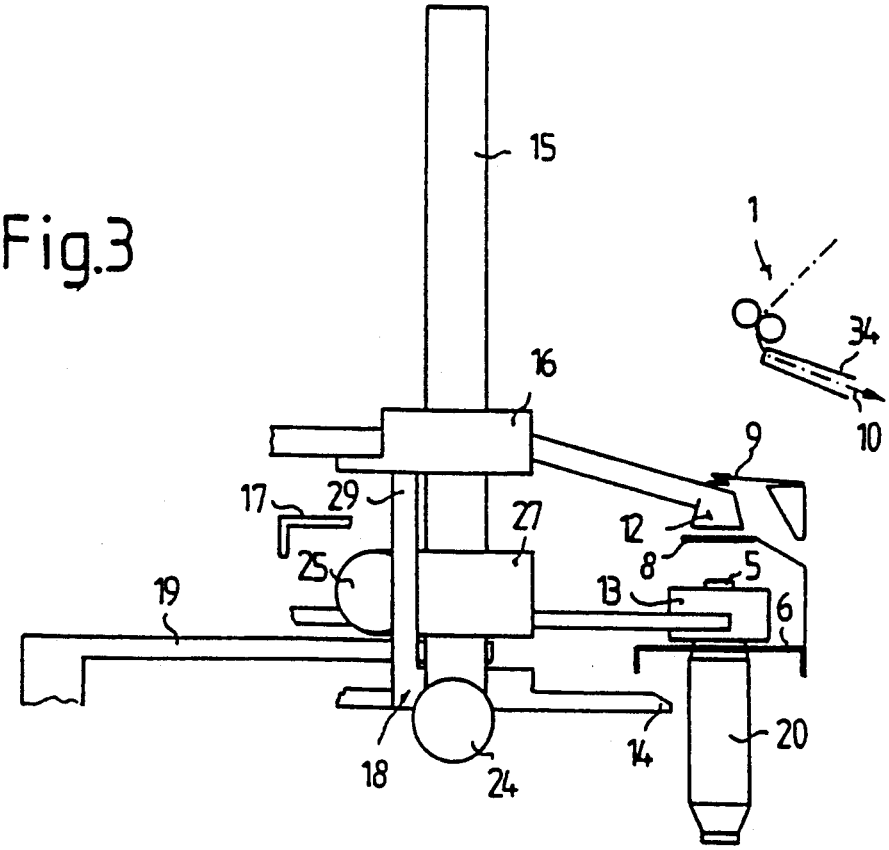
FIG. 3 is a schematic side elevational view of a portion of the yarn end preparing apparatus shown in FIG. 1, showing the suction applying means and the auxiliary yarn length delivery means in their respective tube addressing positions relative to a tube with the ring rail of the textile ring spinning machine in an upper travel position.

As seen in FIG. 3, the yarn end preparing apparatus 11 is also operable to handle a yarn break situation in which the ring rail 6 has been stopped in an upper position. In this situation, the detector 31 detects the positioning of the ring rail in an upper position and, in response to this information signaled to the control unit 30 by the detector 31, the control unit 30 controls the movement of the yarn end preparing apparatus 11 so that none of the elements thereof detrimentally collide with or interfere the components of the ring spinning machine. Thus, to position the suction housing 12, the delivery assembly 13, and the nozzle conduit 14 at their respective vertical positions for subsequent lateral movement into their respective tube addressing positions, the control unit 30 controls the vertical drive motor 23 to raise the guide platform 26 from the position shown in FIG. 1 to the position shown in FIG. 3 in which the second vertical movement stop 29 lifts the carrier 16 from the first vertical movement stop 17 to support the suction housing 12 at an appropriate height in which the suction housing is out of interference with, for example, the yarn guide 9 and the balloon control ring 8. The combined suction applying and air stream applying operations proceed in the same manner as described with respect to FIGS. 2 and 4–9 once the yarn end preparing apparatus 11 has been positioned as shown in FIG. 3.

While the operation of the yarn end preparing apparatus 11 has been described with respect to a mounted disposition on the apparatus on the traveling service unit, the present invention also contemplates that the yarn end preparing apparatus 11 can be mounted in any suitable arrangement adjacent the spindle bank 3 for servicing the tubes and yarn packages supported on the spindles 4 thereof. Also, the present invention contemplates that the control unit 30, which can include the computing capabilities of a personal computer, can be configured to receive signals from conventional detectors or sensors (not shown) disposed on the textile ring spinning machine 1 for sensing the presence or absence of an end of unwound yarn extending from the drafting device 2 and a sensor for detecting the presence or absence or the amount of yarn formed on a tube 5.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A method for restarting a winding operation on a textile spinning machine, the winding operation being an operation in which yarn supplied from a supply package is drafted through a drafting device and wound on a tube to form a full package and the restarting of the winding operation being performed to restart the winding of yarn onto the tube following a break in the yarn being fed from the drafting device to the tube wherein the break in the yarn results in a leading end of unwound yarn which has been drafted through the drafting device but not yet wound on the tube and a trailing end of wound yarn on the tube, the method comprising:

positioning a suction applying means in a tube addressing position at which the suction applying means applies suction to the tube;

positioning a means for delivering a length of auxiliary yarn in a tube addressing position simultaneously with the positioning of the suction applying means in its tube addressing position;

while maintaining the auxiliary yarn length delivery means inactive, controlling the suction applying means to apply suction to the tube to draw the trailing end of wound yarn therefrom to cause the trailing end of wound yarn to extend from the tube to the suction applying means;

then, in the event of and following a failure of the suction applying means to draw in the trailing end of wound yarn, controlling the auxiliary yarn length delivery means to deliver a length of auxiliary yarn to the tube to cause the auxiliary yarn to extend from the tube to the auxiliary yarn length delivery means; and removing the respective operative one of the suction applying means and the auxiliary yarn length delivery means to a yarn extending position in which the respective trailing yarn or auxiliary yarn extending from the tube is disposed generally at a predetermined location for subsequent handling thereof whether the yarn extends to the tube from the suction applying means or from the auxiliary yarn length delivery means.

2. The method according to claim 1 and further comprising intermediately moving the respective one of the suction applying means and the auxiliary yarn length delivery means to an intermediate handling location between the respective tube addressing position and the yarn extending position for intermediate handling of the yarn extending from the tube prior to the moving of the respective one of the suction applying means and the auxiliary yarn length delivery means to the yarn extending position.

3. Apparatus for the restarting of a winding operation on a textile spinning machine, the winding operation being an operation in which yarn supplied from a supply package is drafted through a drafting device and wound on a tube to form a full package and the restarting of the winding operation being performed to restart the winding of yarn onto the tube following a break in the yarn being fed from the drafting device to the tube wherein the break in the yarn results in a leading end of unwound yarn which has been drafted through the drafting device but not yet wound on the tube and a trailing end of wound yarn on the tube, the apparatus comprising:

means for applying suction to the tube to draw the trailing end of wound yarn therefrom, the suction applying means being positionable in a tube addressing position at which it applies suction to the tube;

means for delivering a length of auxiliary yarn to a tube for subsequent winding of the length of auxiliary yarn thereon, the auxiliary yarn length delivering means being positionable in a tube addressing position at which it delivers the length of auxiliary yarn to the tube;

means supporting the suction applying means and the auxiliary yarn length delivery means for simultaneous lateral movement thereof from laterally outward positions toward the tube into their respective tube addressing positions;

means operable during restarting of winding operation after a yarn break for controlling the operation of the suction applying means and the auxiliary yarn length delivery means for sequential operation to first apply suction by the suction applying means to draw in the trailing end of wound yarn on the tube to cause the trailing wound yarn to extend from the tube to the suction applying means and, then, in the event of and following a failure of the suction applying means to draw in the trailing end of wound yarn from the tube, to deliver a length of auxiliary yarn from the auxiliary yarn length delivery means to the tube to cause auxiliary yarn to extend from the tube to the auxiliary yarn length delivery means; and means for moving at least the respective one of the suction applying means and the auxiliary yarn length delivery means from its tube addressing position to a yarn extending position in which the respective trailing yarn or auxiliary yarn extending from the tube is disposed generally at a predetermined location for subsequent handling thereof whether the yarn extends to the tube from the suction applying means or from the auxiliary yarn length delivery means.

4. The apparatus according to claim 3 wherein the supporting means includes a laterally extending guide member, the suction applying means and the auxiliary yarn length delivery means being mounted on the laterally extending guide member for laterally guided movement therealong between their laterally outward positions and their respective tube addressing positions.

5. The apparatus according to claim 4 and further comprising means for applying a stream of air relative to the tube for facilitating the dislodgement of a trailing end of wound yarn therefrom in correspondence with the application of suction to the tube by the suction applying means, the air stream applying means being positionable in a tube addressing position for applying a stream of air to the tube and the supporting means supporting the suction applying means, the auxiliary yarn length delivery means, and the air stream applying means for simultaneous lateral movement thereof from laterally outward positions toward the tube into their respective tube addressing positions.

6. The apparatus according to claim 5 wherein the supporting means includes means for rolling support of the suction applying means, the auxiliary yarn length delivery means, and the air stream applying means along the laterally extending guide member and means for driving the rolling support means along the laterally extending guide member.

7. The apparatus according to claim 4 wherein the tube has a longitudinal axis and the supporting means includes an axial guide member for guiding movement of the suction applying means and the auxiliary yarn length delivery means in an axial direction relative to the axis of the tube.

8. The apparatus according to claim 7 wherein the suction applying means is supported axially above the auxiliary yarn length delivery means relative to the axis of the tube in the direction from the bottom of the tube toward the top of the tube and the supporting means includes a first axial movement stop for limiting axial movement of the suction applying means beyond a first axial location.

9. The apparatus according to claim 8 wherein the supporting means includes a second axial movement stop for limiting axial movement of the suction applying means beyond a second axial location in the direction from one axial end of the tube toward the other axial end of the tube.

10. The apparatus according to claim 4 wherein the supporting means includes means for rolling support of the suction applying means, the auxiliary yarn length delivery means, and the air stream applying means along the laterally extending guide member and means for driving the rolling support means along the laterally extending guide member and a second axial movement stop for limiting axial movement of the suction applying means beyond a second axial location in the direction from the top of the tube toward the bottom of the tube, the second axial movement stop being mounted to the rolling support means for lateral movement therewith along the laterally extending guide member.

11. The apparatus according to claim 4 wherein the supporting means includes means for axially moving the laterally extending guide member relative to the axis of the tube.

12. The apparatus according to claim 11 wherein the supporting means includes an axial guide member for guiding movement of the suction applying means and the auxiliary yarn length delivery means in an axial direction relative to the axis of the tube, the suction applying means and the auxiliary yarn length delivery means each being mounted to the axially extending guide member for axial movement therealong with the suction applying means being disposed axially above the auxiliary yarn length delivery means, and means for driving the auxiliary yarn length delivery means along the axially extending guide means to selectively axially position at least one of the suction applying means and the auxiliary yarn length delivery means.

13. The apparatus according to claim 12 and further comprising means for controlling the axial movement of the laterally extending guide member, the lateral movement of the axially extending guide member along the laterally extending guide member, and the axial movement of the auxiliary yarn length delivery means.

14. The apparatus according to claim 3 and further comprising means for detecting the relative axial position of an axially movable component of the textile spinning machine and means for controlling the axial positioning of the suction applying means in response to the detection of the relative axial position of the textile spinning machine component to effect positioning of the suction applying means out of interference with the textile spinning machine component.

15. The apparatus according to claim 3 wherein the controlling means includes means for detecting the failure of the suction applying means to draw in a trailing end of wound yarn after the lapse of a predetermined period of time.

16. The apparatus according to claim 3 wherein the auxiliary yarn length delivery means includes means for supplying lengths of auxiliary yarn in serially interconnected manner and means for cutting each length of auxiliary yarn from an adjacent length of auxiliary yarn.

* * * * *